US005930204A

United States Patent [19]

Sonoda et al.

[11] Patent Number: 5,930,204

[45] Date of Patent: Jul. 27, 1999

[54] LUMINESCENT DEVICE AND WATCH WITH LUMINESCENT DEVICE

[75] Inventors: Hiroyuki Sonoda, Ome; Shunji Minami, Fussa, both of Japan

[73] Assignee: Casio Computer Co., Ltd., Tokyo, Japan

[21] Appl. No.: 09/140,507

[22] Filed: Aug. 26, 1998

Related U.S. Application Data

[62] Division of application No. 08/889,430, Jul. 8, 1997, Pat. No. 5,838,640.

[30] Foreign Application Priority Data

Jul. 12, 1996 [JP] Japan ..... 8-183319

[51] Int. Cl.[6] ..... G04B 19/06; G04D 3/00

[52] U.S. Cl. ..... 368/67; 368/227; 29/896.32

[58] Field of Search ..... 368/67, 88, 223–228; 362/22, 23, 26–29, 34, 62, 84; 29/896.3, 896.32

[56] References Cited

U.S. PATENT DOCUMENTS

| | | | |
|---|---|---|---|
| 4,775,964 | 10/1988 | Alessio . | |
| 5,703,837 | 12/1997 | Umemoto et al. | 368/88 |
| 5,714,012 | 2/1998 | Murata et al. | 568/10 |

*Primary Examiner*—Vit Miska
*Attorney, Agent, or Firm*—Frishauf, Holtz, Goodman, Langer & Chick

[57] ABSTRACT

The watch and method of manufacture thereof includes an analog hand mechanism having hands in a watch case, and a plate-like luminescent device in the watch case, to illuminate the analog hand mechanism. A metallic layer or a metallic ink layer, for giving a feeling of metallic gloss by receiving illumination of light emitted from the surface of the luminescent device, is disposed on at least a side of the upper surface and the lower surface of the luminescent device.

4 Claims, 8 Drawing Sheets

LUMINESCENT DEVICE AND WATCH WITH LUMINESCENT DEVICE

This is a division of application Ser. No. 08/889,430 filed Jul. 8, 1997, now U.S. Pat. No. 5,838,640.

BACKGROUND OF THE INVENTION

The present invention relates to a luminescent device and a watch with the luminescent device.

An Electro Luminescence element (hereinafter, which may be called "EL luminescent member") is a plate-like luminescent member, from the whole surface of which luminescence are emitted by an applied voltage.

The EL luminescent member, recently, is disposed in various types of electronic apparatuses, e.g., a watch, an electronic pocket notebook and the like. Because the EL luminescent member does not generate heat and the amount of electric power consumed thereby is small, the EL luminescent member has been applied to such types of apparatuses widely.

An example of a conventional watch with an EL luminescent member will be explained briefly in the following.

In case of the conventional watch with the EL luminescent member, a mechanism for driving analog hands is provided in an inner space between a watch glass which is disposed in an upper part of a watch case and a back cover which is disposed in a lower part of the watch case, namely, in the inside of the watch case.

The analog hands mechanism comprises a shaft for hands which extends from the center of the analog hands mechanism upwardly. Hands which comprise a minute hand and an hour hand are connected with the shaft for hands. A dial and a plate-like EL luminescent member in a layered state are placed on the upper surface of the analog hands mechanism. The periphery of the dial and the plate-like EL luminescent member are pressed down by a pressing member, thereby the dial and EL luminescent member are fixed to the watch case.

The dial is made of a translucent film or a light-transmissive color film, on the upper surface of which marks, e.g., time indices or the like, are printed. The EL luminescent member emits light from the entirety of the surface thereof by an electric power or a voltage, for luminescence, which are supplied from a power source provided on a circuit board (an illustration of which is omitted) which is incorporated in the analog hands mechanism. Thereby, the EL luminescent member illuminates the whole dial and the whole hands of the analog hands mechanism, which are provided at an upper position to the EL luminescent member. Therefore, the present time can be read even at night or in the dark from the outside through the dial and the hands illuminated by the EL luminescent member.

According to the structure as described above, because the dial and the like are illuminated by the EL luminescent member, the dial must be made of a material through which light from the EL luminescent member can be transmitted. Therefore, a translucent film or a light-transmissive color film are generally used for the dial.

The entirety of the dial become light by the luminescence from the EL luminescent member to enable reading the time indices and the hands.

Conventionally, because the dial of a watch has a film on the surface thereof, which gives no metallic feeling, there are the problems of being uninteresting and no feeling of high quality.

SUMMARY OF THE INVENTION

The present invention is accomplished in consideration of the conventional problems as described above.

Therefore, an object of the present invention is to provide a luminescent device which is interesting and gives a feeling of high quality, and to provide a watch with such a luminescent device.

In order to accomplish the object of the invention, in accordance with one aspect of the present invention, the luminescent device comprises; a plate-like EL luminescent member, a layer for giving a feeling of metallic gloss by receiving illumination of light emitted from the surface of a plate-like EL luminescent member, which is disposed at least in a side of an upper surface and a lower surface, of the luminescent member, and which is one selected from a metallic layer and a metallic ink layer.

The luminescent member is, for example, one which uses an electro luminescence phenomenon. A pattern having a predetermined shape, time indices for indicating time, and marks which are formed at positions corresponding to those of the time indices are provided on the metallic layer.

Because the metallic layer is formed on the upper surface or the lower surface of the film member, on the luminescent member, a metallic feeling is given to the film member. Additionally, because the film member is light-transmissive, the film member transmits the light from the luminescent member which is disposed at a lower position of the film member, thereby the film member has a metallic lightness and become light.

In accordance with another aspect of the present invention, the luminescent device comprises a plate-like luminescent member, a light-transmissive film member which is disposed at an upper position of the plate-like luminescent member and is illuminated in whole by light from the luminescent member, and a metallic ink layer which is formed on the upper surface of the film member.

Design printed on the film member by using metallic ink is free. For instance, a lattice pattern, a hatching pattern or the like can be printed. Although the printed parts with metallic ink does not transmit light, since the non-printed parts transmit light, the pattern can be clearly observed by contrast of lightness and darkness.

According to the luminescent device as described above, a light-transmissive color film can be disposed at the upper position of the film member, thereby a color metallic feeling can be given.

The watch according to the invention comprises: a watch case comprising an analog hand mechanism having hands, in the inside thereof; a plate-like luminescent device which is provided in the watch case for illuminating the analog hand mechanism in the watch case; and a metallic layer or a metallic ink layer, which gives a feeling of metallic gloss by receiving illumination of light emitted from a surface of the luminescent device, which is disposed at least in a side of an upper surface and a lower surface of the luminescent device.

DESCRIPTION OF THE PREFERRED EMBODIMENT

Figure 1:
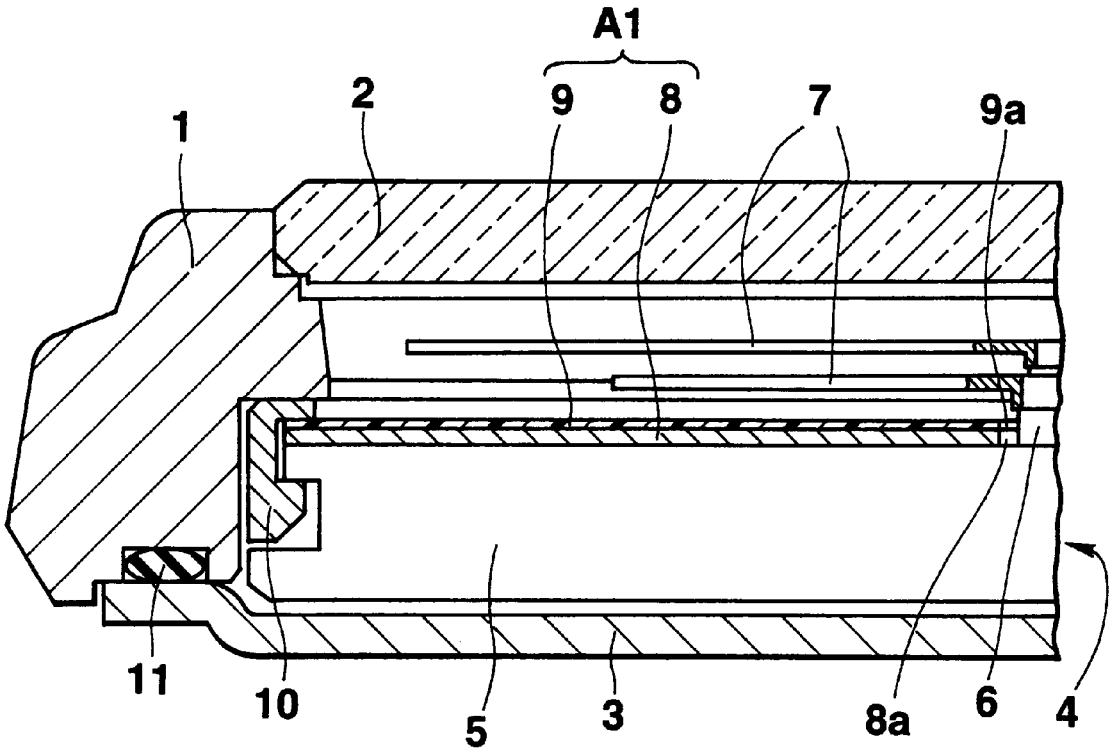
FIG. 1 is a cross sectional view showing a first embodiment of the present invention.

Embodiment 1:

FIG. 1 and FIG. 2 show a first embodiment in which the luminescent device according to the present invention is applied for a watch.

The watch, as shown in FIG. 1, comprises a watch case 1 which has a watch glass 2 provided in an upper side thereof and a back cover 3 provided in a lower side thereof, and an analog hand mechanism 4 which is disposed in the watch case 1.

The analog hand mechanism 4 comprises a circuit board, a body 5 in which a battery and other parts are incorporated, a shafts for hands 6 which extend from the center of the body 5 upwardly, and hands 7 which include a minute hand and an hour hand and the like and which are connected with the shafts for hands 6, respectively.

On the upper surface of the body 5 of the analog hand mechanism 4, a plate-like EL luminescent member 8 and a light-transmissive film member 9 which is made of a transparent material, are layered. A luminescent device A1 comprises the plate-like EL luminescent member 8 and the light-transmissive film member 9.

Through holes 8*a* and 9*a* are formed at each center of the EL luminescent member 8 and the film member 9, wherein the shaft of the hands 6 pass through the through holes 8*a* and 9*a* and extend upwardly.

A pressing member 10 is a member for pressing the peripheries of the film member 9 and the EL luminescent member 8 to fix these members on the body 5. A sealing member 11 is provided between the upper surface of the back cover 3 and the lower surface of the watch case 1.

In the watch having such a structure, when a predetermined voltage is applied from a power source (not shown in Figures) which is provided on a circuit board of the analog hand mechanism 4, the entirety of the surface of the EL luminescent member 8 emits light to illuminate the entirety of the film member 9 which is provided at an upper position of the EL luminescent member 8.

The film member 9 constitutes a dial and has a light-transmissive property. A metallic layer (refer to FIGS. 2A to 2E) is formed on an upper surface and/or a lower surface of the film member 9 by deposition of a metal.

FIGS. 2A to 2E show examples of structures of luminescent devices A1, that is, of layered structures of the film member 9 and the EL luminescent member 8.

Examples of the structures will be explained in detail, as follows.

Figure 2A:
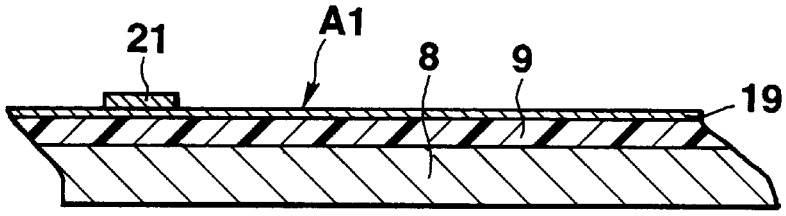
FIGS. 2A to 2E are cross sectional views showing examples of layered structures of the luminescent device according to the first embodiment of the present invention.

In case of the structure of the luminescent device A1 as shown in FIG. 2A, a metallic layer 19 is deposited on the upper surface of the film member 9. Aluminum, silver, gold or the like may be used as a metal for forming the metallic layer 19. In case of this embodiment, a metal is optionally selected from the group of metal, and thereafter the metallic layer 19 is formed on the upper surface of the film member 9 by deposition of the metal selected. Thereby, gloss peculiar to the metal of the metallic layer 19 is given to the upper surface of the film member 9. Therefore, even while the surface of the EL luminescent member 8 does not illuminate, the film member 9 shines with metallic gloss by the function of the metallic layer 19 which is formed on the film member 9, so that the film member 9 can be observed from the outside with the same sense as a metallic dial.

Time indices 21 are printed at positions to be marked, on the upper surface of the film member 9 by offset printing, silk screen printing or the like.

In this FIG. 2A, when the EL luminescent member 8 emits light from the entirety of the surface thereof, the upper surface of the film member 9 shines by the effect of the metallic layer 19 which is formed on the upper surface of the film member 9, and thereby the upper surface or the time indices can be read clearly from the outside.

The metallic layer 19 may be formed on the lower surface of the film member 9 with a difference from the embodiment. That is, the metallic layer 19 may be formed also between the lower surface of the film member 9 and the upper surface of the luminescent member 8.

Figure 2B:
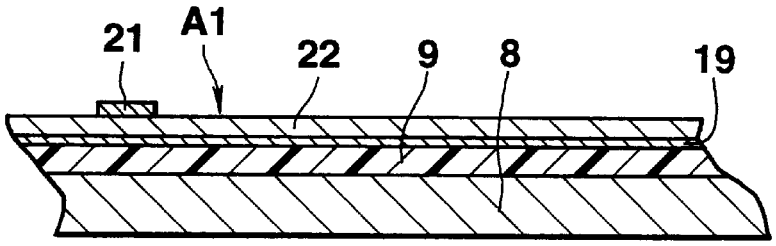

In case of the structure of the luminescent device A1, as shown in FIG. 2B, in addition to the layered structure shown in FIG. 2A, a color film 22 is layered as the top layer of the structure on the upper surface of the metallic layer 19 which is formed on the upper surface of the film member 9. The color film 22 is made of a light-transmissive material, and is colored with suitable color.

Because the color film 22 is layered on the upper surface of the metallic layer 19 on the upper surface of the film member 9 as the top layer of the layered structure, the color of the color film 22 is added to the metallic gloss of the metallic layer 19 which is formed on the upper surface of the film member 9. Therefore, the time indices or the like on the upper surface of the film member 9 is observed with a color metallic feeling because of a state of a mixture of the metallic gloss and the color.

Figure 2C:
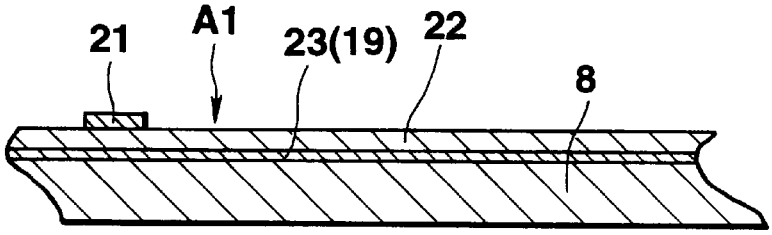

In case of the structure of the luminescent device A1, as shown in FIG. 2C, a metallic layer 23 is formed on the lower surface of the light-transmissive color film 22 by deposition, without the film member 9, and the color film 22 is layered so that the metallic layer 23 faces to the EL luminescent member 8.

That is, in case of the structure shown in FIG. 2C, the metallic layer 23 is formed by deposition between the light-transmissive color film 22 and the EL luminescent member 8 without the film member 9.

In spite of a simple structure which does not include the film member 9, according to such a structure, it is possible not only to observe the time indices or the like with the same color metallic feeling as the structure shown in FIG. 2B but also to make the whole luminescent device, that is, the whole structure comprising the color film 22, the EL luminescent member 8 and the metallic layer 23, thin.

Figure 2D:
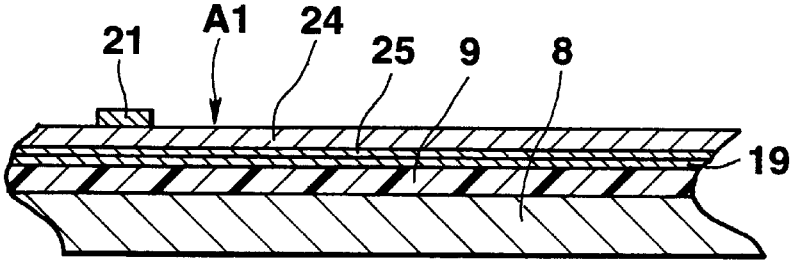

In case of the structure of the luminescent device A1 shown in FIG. 2D, the light-transmissive film member 9 which has the metallic layer 19 deposited on the upper surface thereof is layered on the upper surface of the EL luminescent member 8. A transparent film 24 is layered on the upper surface of the film member 9. A light-transmissive color printed layer 25 is printed on a lower surface of the transparent film 24 by using a color ink, and the transparent film 24 is layered on the film member 9 so that the color printed layer 25 face to the film member 9. Such a structure enables observation with a color metallic feeling. In this case, the color printed layer 25 may be provided on the upper surface of the transparent film 24.

Figure 2E:
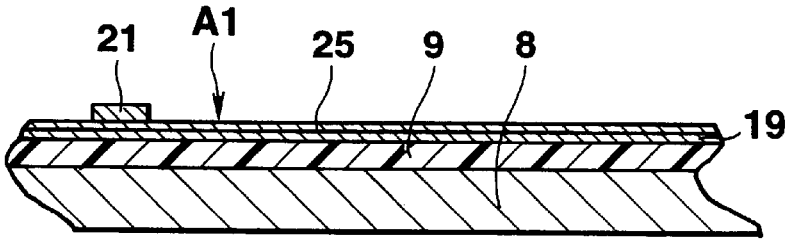

In case of the structure of the luminescent device A1 shown in FIG. 2E, the color printed layer 25 is provided on the upper surface of the light-transmissive film member 9 which has the metallic layer 19 deposited on the surface thereof. Thus, a color metallic feeling is given by the color printed layer 25.

In each of the examples shown in FIGS. 2A to 2E, if an EL luminescent member which emits white light or light of other color is used as an EL luminescent member 8 for emitting light to the whole surface of the film member 9, it is possible to emit the light with the desired color through the whole surface of the film member 9.

Next, an example of manufacturing method of the luminescent device A1 will be illustrated with reference to FIGS. 2F to 2I, as follows.

Figure 2F:
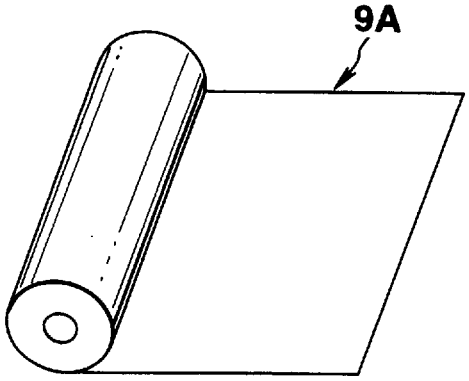
FIGS. 2F to 2I are views showing an example of a manufacturing method of the luminescent device according to the first embodiment of the present invention.
Figure 2G:
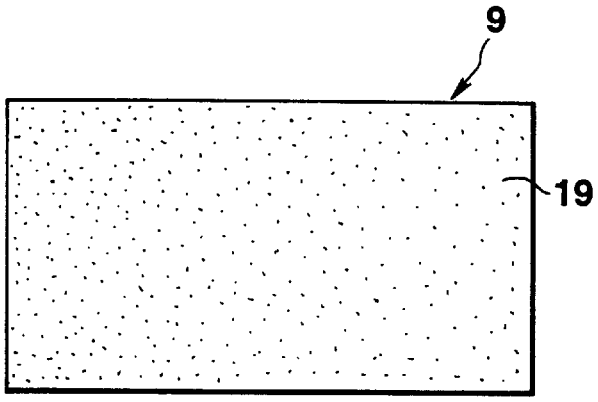

First, a film material 9A which is formed in roll, as shown in FIG. 2F, is cut in a predetermined size, as shown in FIG. 2G. The metallic layer 19 is formed by deposition on the whole upper surface of the cut film member 9. The deposition is half-deposition by which the metallic layer 19 is formed on the whole upper surface of the film member 9 so that the metallic layer 19 is formed extremely thin so as to have a translucent property.

Figure 2H:
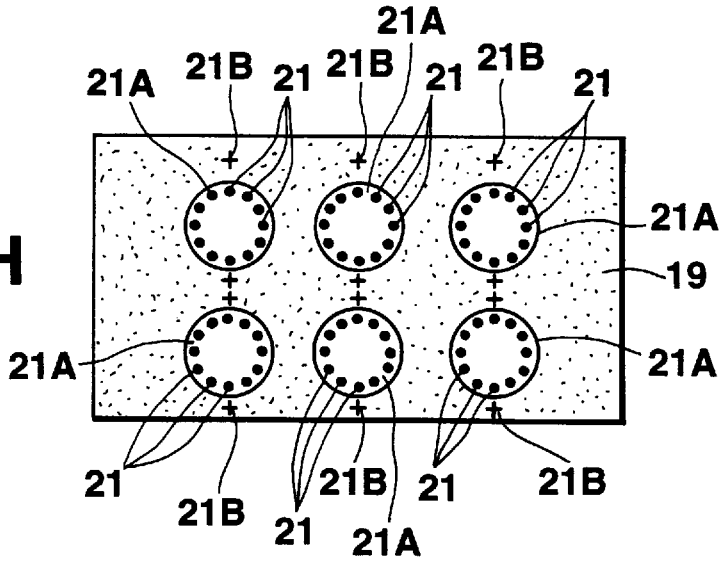

Next, as shown in FIG. 2H, the time indices 21 for showing time of watches, outline parts 21A which show the circle outlines of the watches, and positioning marks 21B for positioning watches 21B are printed by a printing method, e.g., offset printing, silk screen printing or the like.

Figure 2I:
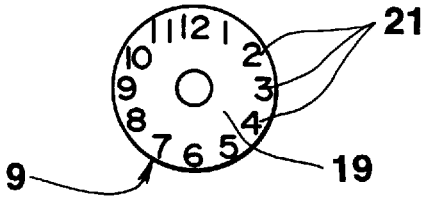

Next, as shown in FIG. 2I, each outline part 21A which is printed on the film member 9 is stamped out by a press machine, thereby the round film members 9 on which the time indices 21 is printed is cut out.

The film member 9 with the time indices 21 manufactured by the above-described steps is disposed on the upper surface of the EL luminescent member 8, as shown in FIG. 2A. As a result, the manufacture of the luminescent device A1 is completed.

Figure 3:
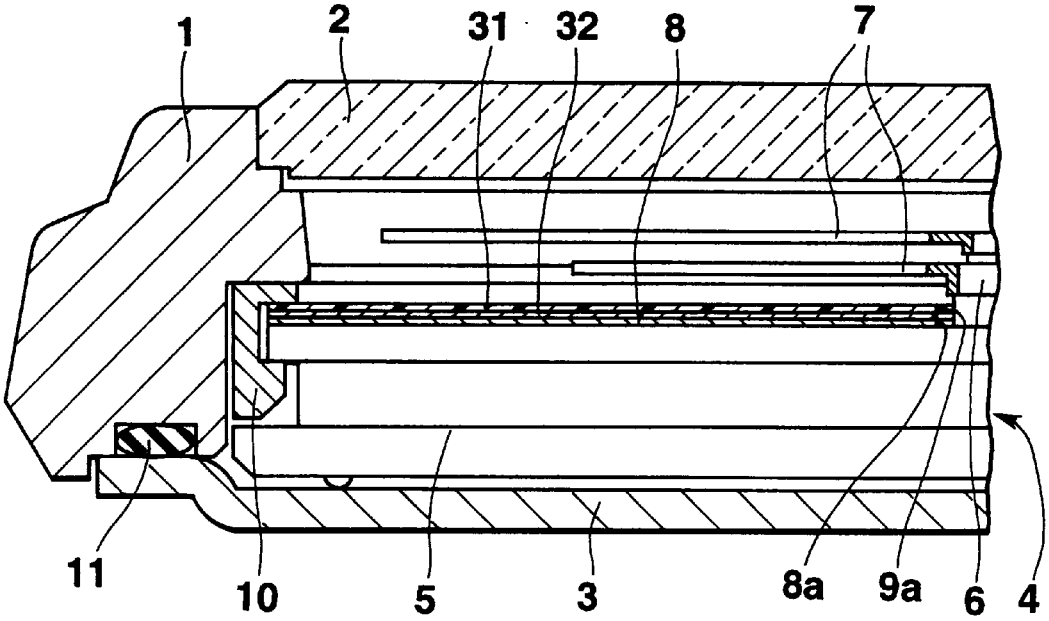
FIG. 3 is a cross sectional view according to the second embodiment of the present invention.
Figure 4A:
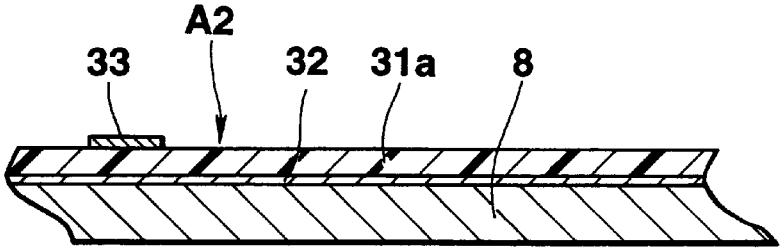
FIGS. 4A and 4B are cross sectional views showing layered structures of the luminescent device according to the second embodiment of the present invention.
Figure 4B:
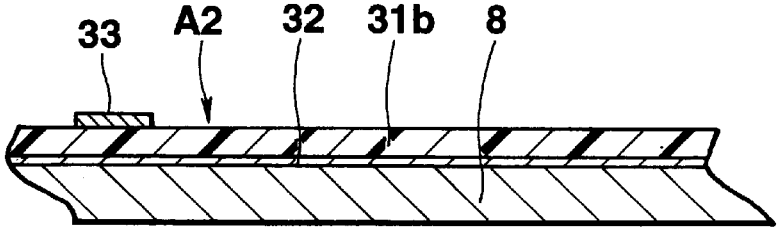
Figure 5:
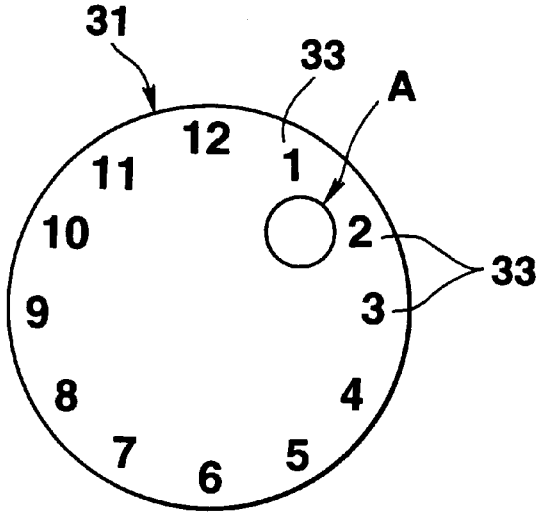
FIG. 5 is a front view of the film member according to the second embodiment of the present invention.

Embodiment 2:

FIGS. 3 to 5 show a second embodiment of the present invention.

In these figures, the same numbers are attached to structural members, elements or the like corresponding to those of the first embodiment.

In this embodiment, as shown in FIG. 3, a metallic ink layer 32 (refer to FIG. 4) is provided on the surface of a light-transmissive film member 31 which is disposed on the upper surface of the EL luminescent member 8. The metallic ink layer 32 is formed by printing with metallic ink which is prepared by mixing powdered metal (e.g., aluminum) to ink.

As described above, the luminescent device A2 according to the second embodiment comprises the EL luminescent member 8, the light-transmissive film member 31 provided on the upper surface of the EL luminescent member 8, and the metallic ink layer 32 formed on the surface of the film member 31.

FIGS. 4A and 4B show concrete examples of layered structures of the luminescent device A2 in the embodiment shown in FIG. 3.

That is, in case of the structure of the luminescent device A2 shown in FIG. 4A, a transparent film 31*a* having a light-transmissive property is used as the film member 31.

In case of the structure of the luminescent device A2 shown in FIG. 4B, a light-transmissive color film 31*b* is used as the film member 31.

The metallic ink layer 32 is provided on the each lower surface of the transparent film 31*a* and the color film 31*b*. In FIG. 4B, an EL luminescent member which emits white light is used as the EL luminescent member 8.

FIG. 5 shows these film members 31 (31*a* and 31*b*).

As described above and shown in FIGS. 4A and 4B, the metallic ink layer 32 is provided on each lower surface of the transparent film 31*a* and the color film 31*b* as the film member 31, while time indices 33 are printed on each upper surface of the transparent 31*a* and the color film 31*b* at positions for indication of time.

Figure 6A:
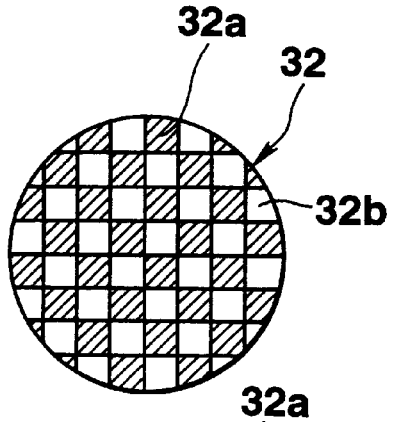
FIGS. 6A and 6B are enlarged bottom views showing examples of the part "A" in FIG. 5.
Figure 6B:
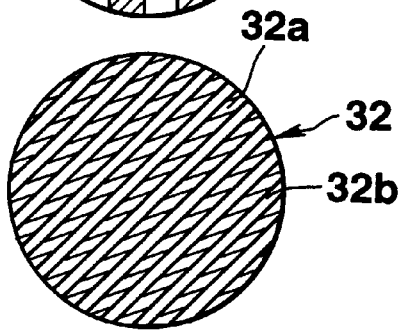

FIGS. 6A and 6B show patterns of the metallic layer 19 formed on the film member 9 shown in FIGS. 2A to 2E, and of the metallic ink layer 32 formed on the lower surface of the film member 31*a* or 31*b* shown in FIGS. 4A and 4B.

First, the pattern of the metallic ink layer 32 will be explained. FIG. 6A is an enlarged figure of the part "A" of the film member 31 shown in FIG. 5. In the metallic ink layer, each printed part 32*a* (non-light-transmissive part) printed by metallic ink and each non-printed part 32*b* (light-transmissive part) is formed in square, and each square of printed part 32*a* and of non-printed part 32*b* are repeated mutually lengthwise and crosswise to make a lattice pattern.

A pattern shown in FIG. 6B which is another enlarged figure of the part "A" of the film member 31 in FIG. 5 is a hatching pattern, wherein the printed parts 32*a* and the non-printed parts 32*b* are formed obliquely and repeated mutually.

In the state in which the pattern is provided as described above, when the EL luminescent member 8 emits light, although the printed parts 32*a* does not transmit light, the non-printed parts 32*b* transmit light. Therefore, the light parts through which light pass and the dark parts through which light does not pass can be observed from the outside with a clear contrast, thereby such a very interesting watch can be provided. In this case, the time indices 33 can be looked with a good contrast, thereby it is possible to improve the interesting visibility.

This embodiment is not limited to such patterns as shown in Figures, e.g., a design, a letter, a symbol, or a mark can be also used.

Figure 7:
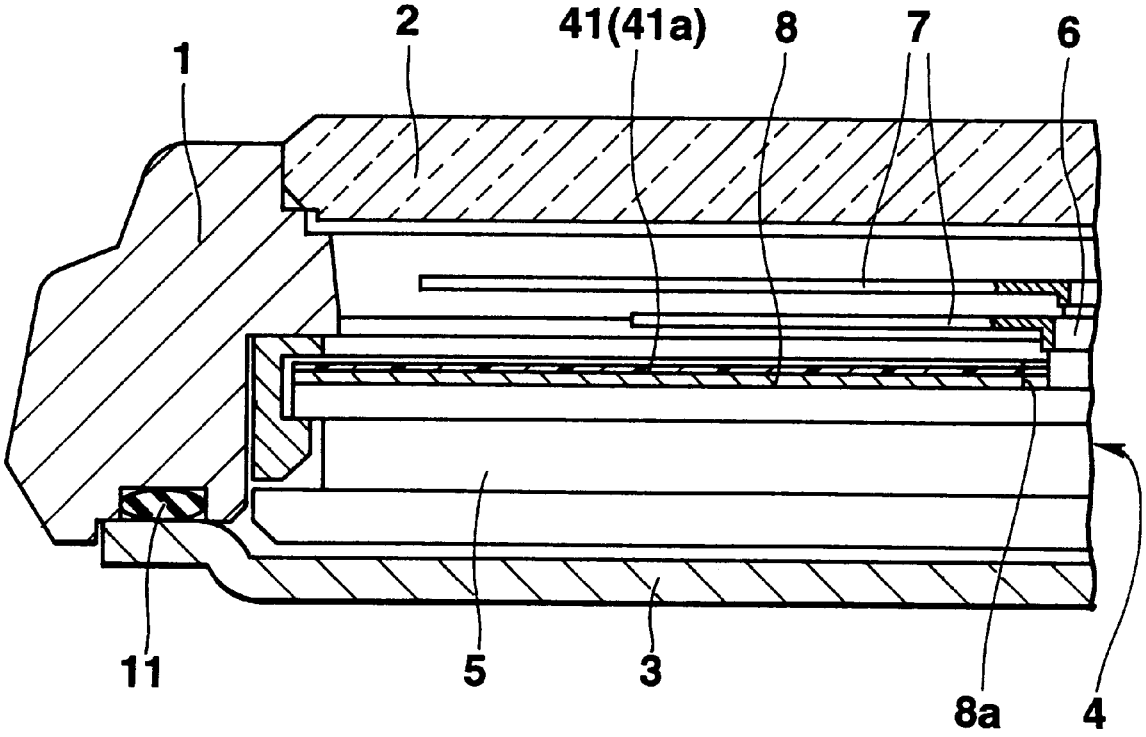
FIG. 7 is a cross sectional view showing a third embodiment according to the present invention.

Embodiment 3:

FIGS. 7 to 9 show a third embodiment of the present invention.

In this embodiment, as shown in FIG. 7, a film member 41 is layered on the upper surface of the EL luminescent member 8. The film member 41 has structures shown in FIGS. 8A to 8D and FIG. 9.

Figure 8A:
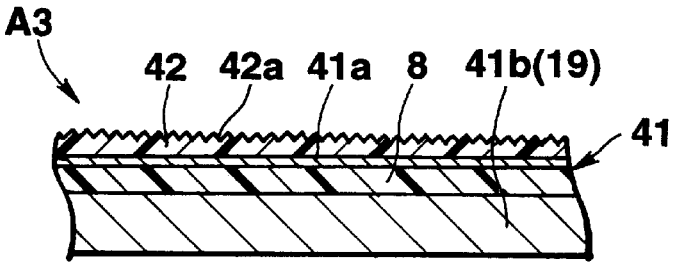
FIGS. 8A to 8D are cross sectional views showing examples of layered structures of the luminescent device according to the third embodiment of the present invention.

In case of the structure of a luminescent device A3 shown in FIG. 8A, a transparent film 42 is layered on a light-transmissive film 41*a* which has a metallic layer 41*b* formed by deposition on the upper surface thereof. A fine unevenness 42*a* is formed on the upper surface of the transparent film 42. The unevenness 42*a* is formed by an electric casting or the like, and light from the EL luminescent member 8 is scattered by the unevenness 42*a*. Therefore, a metallic feeling of the film 41*a* becomes tender, and the impression is softened.

Figure 8B:
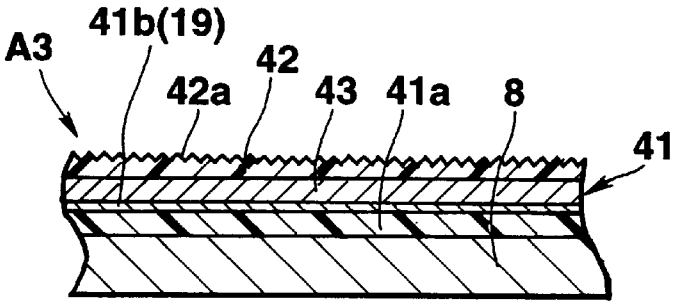

In case of the structure of the luminescent device A3 shown in FIG. 8B, a transparent color film 43 is provided between the transparent film 41*a* which has the metallic layer 41*b* formed by deposition on the upper surface thereof, and the transparent film 42 which has the unevenness 42*a* formed at the surface. A colored soft metallic feeling is given since the color film 43 is layered.

Figure 8C:
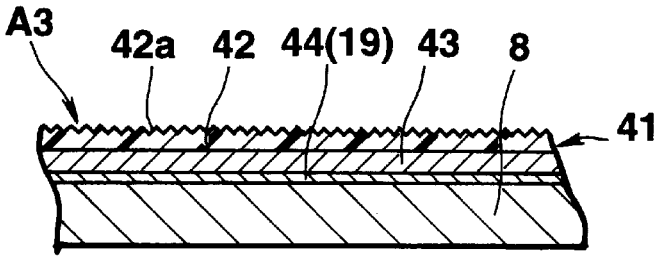

In case of the structure of the luminescent device A3 shown in FIG. 8C, a metal deposited layer 44 covers the lower surface of the light-transmissive color film 43. Because the transparent film 42 with the unevenness 42*a* is layered on the color film 43, the same advantageous effects as the embodiment shown in FIG. 8B is given.

Figure 8D:
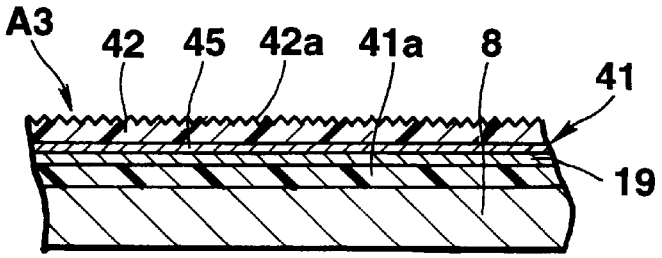

In case of the structure of the luminescent device A3 shown in FIG. 8D, a light-transmissive color ink layer 45 is provided on the lower surface of the transparent film 42 with the unevenness 42*a*, and the transparent film 42 is layered on the light-transmissive film 41*a* on which the metallic deposited layer 44 is provided.

Figure 9A:
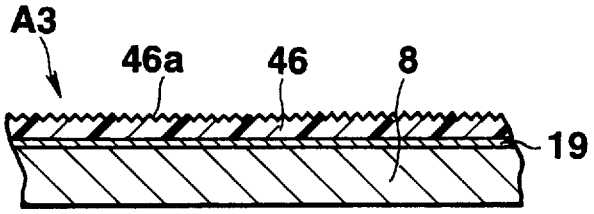
FIGS. 9A to 9E are cross sectional views showing other examples of layered structures of the luminescent device according to the third embodiment of the present invention.

In case of the structure of the luminescent device A3 shown in FIG. 9A, a fine unevenness 46*a* is formed on an upper surface of a light-transmissive film 46 on which metal is deposited. The film 46 is layered o n the EL luminescent member 8. Thereby, the film 46 shows the same advantageous effect as the transparent film 42 of the structure shown in FIG. 8A.

Figure 9B:
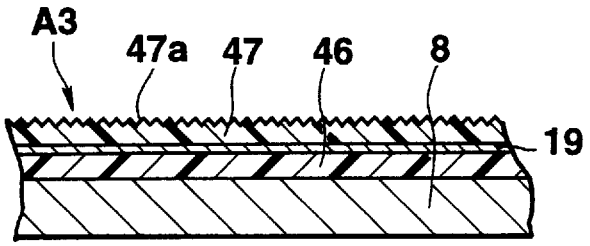

In case of the structure of the luminescent device A3 shown in FIG. 9B, a fine unevenness 47*a* is formed on an upper surface of a light-transmissive color film 47, and the color film 47 is layered on the light-transmissive film 46 on which metal is deposited.

Figure 9C:
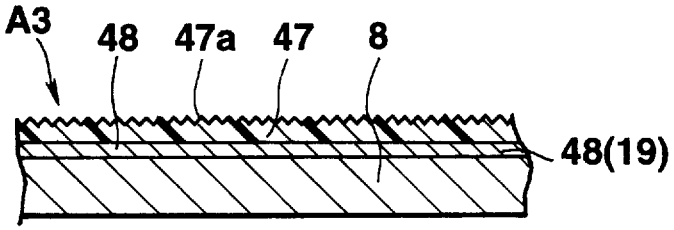

In case of the structure of the luminescent device A3 shown in FIG. 9C, a metal deposited layer 48 is formed on the lower surface of the light-transmissive color film 47 which has the unevenness 47*a* formed on the upper surface thereof, and the color film 47 is layered on the EL luminescent member 8.

Figure 9D:
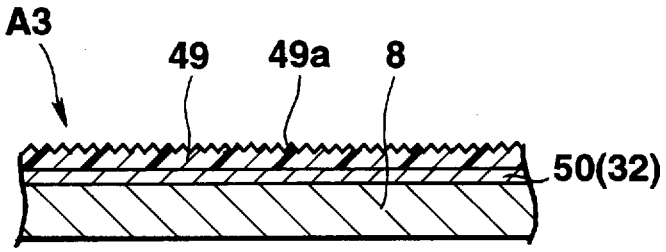

In case of the structure of the luminescent device A3 shown in FIG. 9D, a metallic ink layer 50 is formed on a lower surface of a transparent film 49 similar to the second embodiment, in addition to this, a fine unevenness 49*a* is formed on an upper surface of the transparent film 49.

Figure 9E:
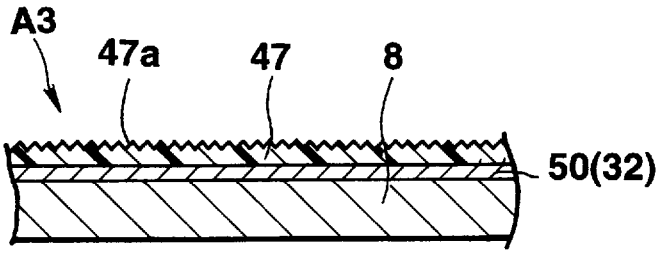

In case of the structure of the luminescent device A3 shown in FIG. 9E, the metallic ink layer 50 is formed on the lower surface of the light-transmissive color film 47 which has the unevenness 47*a* formed on the upper surface thereof.

In the above-described explanation, although only embodiments in which EL luminescent device as a luminescent device is used are described, various plate-like luminescent devices, e.g., a lamp, a fluorescent lamp or the like, can be used for the present invention. The present invention is applied similarly for another electronic apparatus except a watch, e.g., an electronic pocket notebook, a pager, a personal computer or the like.

As described above, in the present invention, because the metallic layer 19, which shows metallic gloss by receiving illumination from the surface of the luminescent member 8, is formed by deposition or the like on at least a side of the upper surface and the lower surface of the EL luminescent member 8, a metallic feeling is given and a feeling of high quality are given to a user. In the other embodiment of the present invention, because the metallic ink layer 32 is formed by printing method or the like, it is possible to give a metallic feeling. Additionally, because the metallic ink layer 32 cab be formed in various colors, the appearance by contrast of light can be improved.

According to the watch of the present invention, it is possible to improve the feeling of high quality and goodness of appearance by using the film member as a dial, on which metallic deposition or metallic ink print is provided.

What is claimed is:

1. A method for manufacturing a luminescent device for watches, comprising the step of:

forming a metallic layer on a whole upper surface of a film member;

printing (i) a plurality of outline parts for showing outlines of the watches, and (ii) time indices which are arranged in each of the outline parts for showing time of each watch, on an upper surface of the formed metallic layer;

stamping out the film member having the printed time indices thereon in a predetermined shape to cut the film member out along the printed outline parts; and thereafter placing the stamped-out film member having the printed time indices, on an upper surface of an EL luminescent member.

2. A method as claimed in claim 1, further comprising a step of printing a positioning mark on the metallic layer, which positioning mark is printed at a predetermined position near the outline part, and which positioning mark is used for positioning when stamping out the film member.

3. A method as claimed in claim 1, wherein the metallic layer is formed on the whole upper surface of the film member by deposition.

4. A method as claimed in claim 1, wherein the metallic layer is formed thin so as to be translucent to a light emitted through a whole surface of the EL luminescent member.

* * * * *